US008059980B2

(12) United States Patent
Okamoto

(10) Patent No.: US 8,059,980 B2
(45) Date of Patent: Nov. 15, 2011

(54) IMAGE FORMING APPARATUS WITH IMPROVED TRANSFER ROLLER

(75) Inventor: Sueaki Okamoto, Osaka (JP)

(73) Assignee: Kyocera Mita Corporation (JP)

( * ) Notice: Subject to any disclaimer, the term of this patent is extended or adjusted under 35 U.S.C. 154(b) by 336 days.

(21) Appl. No.: 12/420,870

(22) Filed: Apr. 9, 2009

(65) Prior Publication Data

US 2009/0257764 A1 Oct. 15, 2009

(30) Foreign Application Priority Data

Apr. 11, 2008 (JP) ..... 2008-103191

(51) Int. Cl.
*G03G 15/01* (2006.01)

(52) U.S. Cl. ..... 399/66; 399/45; 399/313

(58) Field of Classification Search ..... 399/44, 399/45, 66, 313, 316
See application file for complete search history.

(56) References Cited

U.S. PATENT DOCUMENTS

| | | | | |
|---|---|---|---|---|
| 7,606,507 | B2 * | 10/2009 | Soshiroda | 399/66 |
| 2010/0215387 | A1 * | 8/2010 | Ishikawa | 399/45 |

FOREIGN PATENT DOCUMENTS

| | | | |
|---|---|---|---|
| JP | 05127458 | A * | 5/1993 |
| JP | 07168465 | A * | 7/1995 |
| JP | 10020615 | A * | 1/1998 |
| JP | 2001005311 | A * | 1/2001 |
| JP | 2001-106374 | | 4/2001 |

* cited by examiner

*Primary Examiner* — Robert Beatty
(74) *Attorney, Agent, or Firm* — Gerald E. Hespos; Michael J. Porco

(57) ABSTRACT

An image forming apparatus is provided with an image bearing member for transferring an image to a transfer material using a developer, a transfer roller arranged in contact with the circumferential surface of the image bearing member for forming a transfer nip portion, and a displacing drive part for displacing a surface contact position corresponding to a position of the circumferential surface of the image bearing member where the transfer nip portion is formed by the contact of the transfer roller at least to either one of a first position and a second position different from the first position.

16 Claims, 12 Drawing Sheets

FIG. 5

| IMAGE FORMING PROCESS ENVIRONMENT INFORMATION | FIRST POSITION | SECOND POSITION |
|---|---|---|
| TRANSFER MATERIAL THICKNESS INFORMATION | PLAIN PAPER | PASTEBOARD |
| TRANSFER MATERIAL SIZE INFORMATION | SMALL | LARGE |
| SHEET FEED INFORMATION | DUPLEX | SIMPLEX |
| TEMPERATURE / HUMIDITY INFORMATION | LOW TEMPERATURE/ LOW HUMIDITY | HIGH TEMPERATURE/ HIGH HUMIDITY |
| PRINT IMAGE INFORMATION (CHARACTER) | TONER SCATTERING | VOID OF OTHER THAN EDGE PARTS |
| PRINT IMAGE INFORMATION (SOLID / HALFTONE) | OMISSION OF IMAGE | ELECTROSTATIC SCATTERING |
| PRINT IMAGE INFORMATION (LINE) | VOID OF OTHER THAN EDGE PARTS | TONER SCATTERING |
| COVERAGE RATE INFORMATION | HIGH | LOW (INCLUDING BLANK) |
| SURFACE SMOOTHNESS INFORMATION | GOOD | POOR |

IMAGE FORMING APPARATUS WITH IMPROVED TRANSFER ROLLER

BACKGROUND OF THE INVENTION

1. Field of the Invention

The present invention relates to an image forming apparatus, particularly to an image forming apparatus provided with at least one of a copy function, a print function and a facsimile function.

2. Description of the Related Art

There is known an image forming apparatus provided with an image bearing member having an image (toner image) to be transferred to a transfer material (e.g. transfer sheet) formed on a surface thereof by using toner as developer and a transfer roller for forming a transfer nip portion by the contact with the image bearing member to transfer an image formed on the image bearing member to the transfer material in a developing device.

If this image forming apparatus forms a monochromatic image, the transfer nip portion is formed by the contact of the transfer roller with a photoconductive drum. On the other hand, if this image forming apparatus forms a color image, the transfer nip portion is formed by the contact of the transfer roller with an intermediate transfer belt. In such a state, the transfer material is conveyed to the transfer nip portion.

When the transfer material is convened to the transfer nip portion, a transfer bias is applied to the transfer roller to generate a transfer electric field between the photoconductive drum or the intermediate transfer belt (hereinafter, image bearing member) and the transfer roller. At this time, an image formed on the surface of the photoconductive drum or the intermediate transfer belt is transferred to the transfer material.

If no proper air gap is provided between the image bearing member and the transfer material, discharge occurs between the image bearing member and the transfer material, whereby a phenomenon of diffusing the toner on the surface of the image bearing member to the periphery of an original transfer position of the transfer material without being transferred to this original transfer position is likely to occur.

If the air gap is wide, the following phenomenon tends to occur. Specifically, if the air gap is wide, spot discharge is likely to occur between the transfer roller and the transfer material immediately before the transfer material reaches the transfer nip portion. Upon the occurrence of such spot discharge, the polarity of the toner to form the image on the surface of the image bearing member is locally reversed. Thus, a phenomenon (so-called white spot phenomenon) in which toner untransferred parts appear in dots occurs on the transfer material having the image transferred thereto.

Further, if the air gap is wide, discharge is likely to occur in a wide area between the transfer roller and the transfer material immediately before the transfer material reaches the transfer nip portion. such discharge has an influence over the wide area of the toner to form the image on the surface of the image bearing member. Then, the polarity of the toner is reversed in a specific area of the surface of the image bearing member. Thus, a phenomenon in which a toner untransferred part appears over a specific area occurs on the transfer material having the image transferred thereto. Other phenomena of transfer failures also tend to occur.

Thus, the following measures have been adopted to make the air gap sufficiently small. For example, a method for guiding a transfer material entering direction toward the image bearing member by a pre-transfer guide or the like is adopted. Further, a method for changing the position of the transfer nip portion to a position on the circumferential surface of the image bearing member at an upstream side in a conveying direction of the transfer material is adopted to make the transfer material having passed the transfer nip portion easily separable from the image bearing member and the transfer roller. By these measures, the air gap is made sufficiently small.

However, in such cases, if a highly rigid transfer material such as a pasteboard is used, the transfer material is likely to be bent in a thickness direction of the transfer material in a conveyance path since being conveyed while the leading end thereof is colliding with the image bearing member. If such a phenomenon occurs, a conveyance path from registration rollers disposed upstream of the transfer nip portion for feeding the transfer material to the conveyance path to the transfer nip portion is bent by being pushed by the transfer material.

If the conveyance path from the registration rollers to the transfer nip portion is bent, resistance hindering the conveyance of the transfer material increases in the conveyance path. Thus, in a conveyance process, a conveying speed of a part of the transfer material having entered the conveyance path after passing the registration rollers is slower than that of a part of the transfer material passing the registration rollers.

In such a case, there is, for example, a large tendency to occur image faults such as horizontal stripes in an image transferred to the transfer material. There is also a large tendency of not properly transferring the image due to an upward movement of the rear of the transfer material. Further, there is a large tendency of reducing an equal magnification in a conveying direction (a sub scanning direction) of an image. There are also large tendencies of other problems.

SUMMARY OF THE INVENTION

An object of the present invention is to realize the conveyance of a transfer material and the transfer of an image to the transfer material in conformity with a change of a condition such as the thickness of the transfer material.

In order to accomplish this object, an image forming apparatus according to one aspect of the present invention is directed to an image forming apparatus, comprising an image bearing member for transferring an image to a transfer material using a developer; a transfer roller arranged in contact with the circumferential surface of the image bearing member for forming a transfer nip portion; and a displacing drive part for displacing a surface contact position corresponding to a position of the circumferential surface of the image bearing member where the transfer nip portion is formed by the contact of the transfer roller at least to either one of a first position and a second position different from the first position.

These and other objects, features, aspects and advantages of the present invention will become more apparent upon a reading of the following detailed description and accompanying drawings.

BRIEF DESCRIPTION OF THE DRAWINGS

FIG. 5 is a table showing conditions for switching the surface contact position between the first and second positions.

DETAILED DESCRIPTION OF THE PREFERRED EMBODIMENTS

Figure 1:
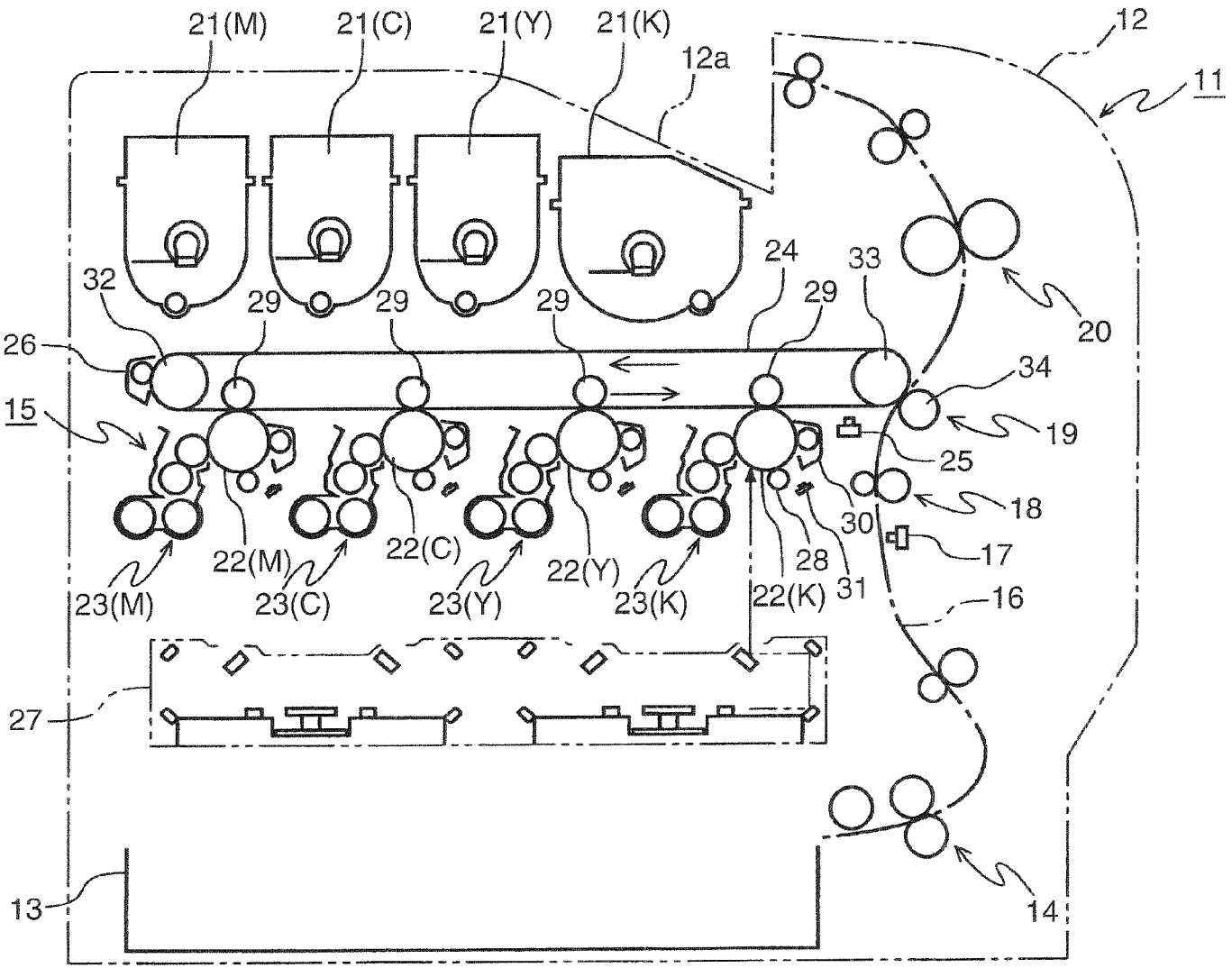
FIG. 1 is a diagram showing a tandem color printer as an image forming apparatus according to one embodiment of the invention.

In order to prevent an increase of resistance hindering the conveyance of a transfer material in a conveyance path, for example, upon conveying a highly rigid transfer material such as a pasteboard in the conveyance path, an elastic member for reducing resistance created upon passing the pasteboard along the conveyance path is disposed upstream of a transfer nip portion in the conveyance path in a conveying direction of the transfer material in Japanese Unexamined Patent Publication No. 2001-106374.

However, a degree of reducing a conveyance load differs depending on conditions such as the thickness of the transfer material and the size of the transfer material in a width direction orthogonal to the conveying direction. Thus, it has been difficult to deal with all kinds of transfer materials.

A state of tension of the transfer material differs between an intermediate part and a rear part of the transfer material being conveyed. Thus, when the rear of the transfer material is separated from the elastic member, the rear is likely to leap upward due to an elastic restoring force of the elastic member. Therefore, there has been a problem of easy transfer failure such as a displacement of a transfer position of an image to a transfer material (transfer displacement).

Even upon adopting the method for changing the position of the transfer nip portion to a position of the circumferential surface of an image bearing member at an upstream side in the conveying direction of the transfer material, it remains unchanged that a spacing in a thickness direction of a recording sheet is small in a conveyance path from registration rollers to the transfer nip portion. Therefore, a conveyance load remains to be large upon conveying a pasteboard.

Further, if a force of the transfer roller to press the image bearing member is increased to increase a pasteboard conveying force, the following problem could occur. In other words, since the pressing force corresponds to the conveyance of the pasteboard, the following problem could occur if the strong pressing force acts on a plain paper. Specifically, if the pressing force is unnecessarily increased upon conveying a plain paper, resistance hindering the conveyance of the plain paper is created not only in the conveyance path, but also in the transfer nip portion. In such a case, a phenomenon of reducing an equal magnification in the conveying direction (sub scanning direction) occurs, whereby an image transferred to the plain paper is contracted in the conveying direction(sub scanning direction).

Such a phenomenon occurs for the following reason. Specifically, the plain paper can be conveyed with the assistance of a conveying force by the registration rollers while the plain paper is receiving the conveyance force from the registration rollers. However, after the entire plain paper passes the registration rollers, a conveying speed is reduced by the above resistance since the plain paper receives no conveying force from the registration rollers. Thus, the conveying speed could change before and after the rear of the plain paper passes the registration rollers, wherefore the equal magnification in the conveying direction (sub scanning direction) could be reduced.

If the pressing force of the transfer roller is increased, only edge parts (toner present on boundaries with the surface of the image bearing member out of the toner forming the image on the image bearing member) in the image formed on the image bearing member could be transferred to the transfer material. Thus, a phenomenon of not transferring the toner in parts other than the edge parts occurs in the image transferred to the transfer material. If such a phenomenon occurs, parts other than the outline of the image are voided on the transfer material, for example, when an image representing a character or a thick line is transferred to the transfer material.

The present invention was developed to solve these problems.

One embodiment of the present invention is described below with reference to the accompanying drawings.

(Overall Construction)

As shown in FIG. 1, a tandem color printer 11 as an image forming apparatus according to one embodiment of the present invention is provided with a sheet cassette 13 for storing transfer materials (not shown) and a sheet feeding unit 14 for dispensing the transfer materials from the sheet cassette 13 in a printer main body 12. The color printer 11 is also provided, in the printer main body 12, with an image forming station 15 for performing an image forming process to a transfer material supplied from the sheet cassette 13 or a manual feed tray (not shown) and a transfer material conveyance path 16 for conveying the transfer material supplied from the sheet cassette 13 or the manual feed tray.

Figure 2:
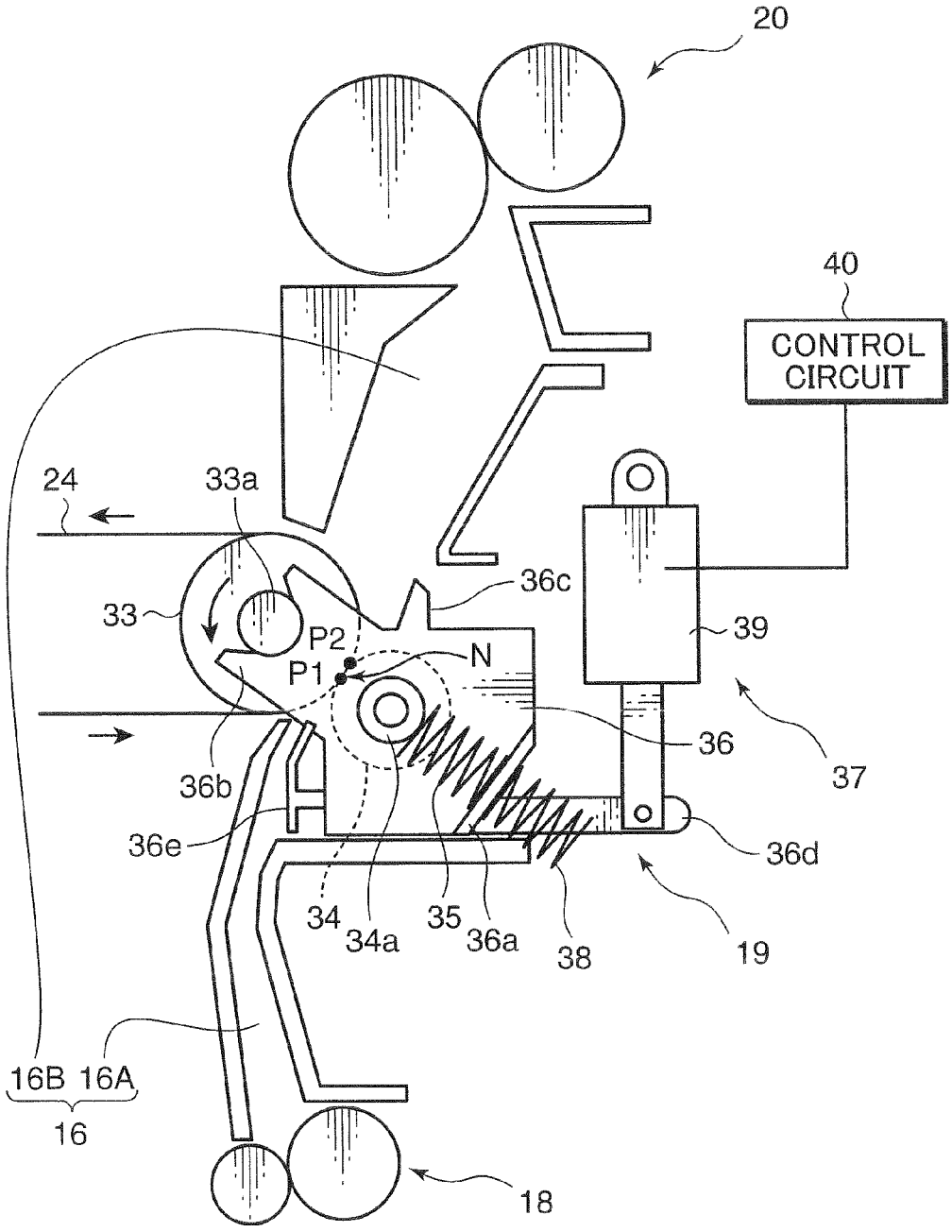
FIG. 2 is a diagram of an exemplary periphery of a secondary transfer device showing a state where a surface contact position corresponding to a position where a transfer nip portion is formed is set to a first position.

In such a color printer 11, the transfer material conveyance path 16 includes a first transfer material conveyance path 16A and a second transfer material conveyance path 16B as shown in FIG. 2. In FIG. 2, the first transfer material conveyance path 16A is a conveyance path for conveying the transfer material from a pair of registration rollers 18 to a transfer nip portion N. Further, in FIG. 2, the second transfer material conveyance path 16B is a conveyance path for conveying the transfer material having passed the transfer nip portion to downstream devices.

As shown in FIG. 1, the color printer 11 is also provided in the printer main body 12 with a registration sensor 17 for detecting the transfer material conveyed by the transfer material conveyance path 16. As shown in FIG. 1, the color printer 11 is also provided in the printer main body 12 with the pair of registration rollers 18 for correcting the conveying direction of the transfer material conveyed to the inside of the printer main body 12 and controlling a conveyance timing of the transfer material in a direction toward a transfer roller 34. As shown in FIG. 1, the color printer 11 is also provided with a secondary transfer device 19 for transferring an image (toner image) formed (primarily transferred) in the image forming station 15 to the transfer material and a fixing device 20 for fixing the image transferred by the secondary transfer device 19 to the transfer material in the printer main body 12.

(Image Forming Station 15)

The image forming station 15 forms images by a tandem method. The tandem method is a method for performing the image forming process, for example, using toners (developers) of four colors, i.e. yellow (Y), magenta (M), cyan (C) and black (K). In the following description, colors of Y, M, C and K are attached in parentheses to numerical references only in the case of particularly specifying the colors. Only numerical references are attached except in the case of specifying the colors.

The image forming station 15 includes a plurality of toner containers 21 containing toners to be supplied in correspondence with the respective colors Y, M, C and K. The image forming station 15 also includes a plurality of photoconductive drums (image bearing members) 22 made of an amorphous silicon for forming the images using the toners of the respective colors based on image data contained in print data transmitted from a personal computer or the like.

The image forming station 15 further includes a plurality of developing devices 23 for supplying the toners to the respective photoconductive drums 22, and an endless intermediate transfer belt (transfer belt; image bearing member) 24, to which the images formed on the respective photoconductive drums 22 are primarily transferred. The image forming station 15 also includes image density detecting sensors 25 for measuring a reflection density of the image on a surface of the intermediate transfer belt. These image density detecting sensors 25 are arranged, for example, between the photoconductive drum 22(K) arranged at a most downstream side in a turning direction of the intermediate transfer belt 24 and the secondary transfer device 19.

The image forming station 15 also includes a cleaning device 26 disposed upstream of the photoconductive drum 22(M) for first performing a primary transfer to the transfer material in the turning direction of the intermediate transfer belt 24 and adapted to remove residual toner and the like attached to the surface of the intermediate transfer belt 24, and an exposing device 27 for emitting beam fluxes to the photoconductive drums 22.

The respective photoconductive drums 22 bear the images of the corresponding colors on the surfaces thereof based on the beam fluxes emitted from the exposing device 27 and transfer the images to the surface of the intermediate transfer belt 24. The respective photoconductive drums 22 are arranged below the intermediate transfer belt 24 together with the developing devices 23. Around each photoconductive drum 22, a charging device 28, the exposure device 27, the developing device 23, a primary transfer roller 29, a cleaning device 30 and a discharging device 31 are arranged in the order of a transfer process.

In such an image forming station 15, the images carried on the respective photoconductive drums 22 are transferred to the surface of the intermediate transfer belt 24 by the cooperation of the respective photoconductive drums 22 and the primary transfer rollers 29 provided in correspondence with the photoconductive drums 22. The image thus transferred to the surface of the intermediate transfer belt 24 in the image forming station 15 is transferred to the transfer material conveyed via the first transfer material conveyance path 16A by the secondary transfer device 19.

The respective developing devices 23 basically having the same construction are arranged adjacent to each other along the turning direction of the intermediate transfer belt 24 below the intermediate transfer belt 24. Known developing devices are used as the developing devices 23. Thus, the construction of the developing devices is not limited to that of the developing devices 23 shown in FIG. 1.

The intermediate transfer belt 24 is an endless belt horizontally arranged in the printer main body 12. Such an intermediate transfer belt 24 is driven to turn in an arrow direction indicated by arrows in FIG. 1 by a drive roller 32 and a driven roller 33. With the intermediate transfer belt 24 driven to turn in this way, the images are transferred to the surface of the intermediate transfer belt 24 by the respective photoconductive drums 22 and the primary transfer rollers 29 corresponding to the respective photoconductive drums 22. The intermediate transfer belt 24 having the images transferred thereto functions as the image bearing member in the secondary transfer device 19 to be described later.

The images thus transferred to the surface of the intermediate transfer belt 24 are transferred to the transfer material conveyed via the first transfer material conveyance path 16A in the secondary transfer device 19. It should be noted that the driven roller (back-up roller) 33 can maintain a state of tension of the intermediate transfer belt 24 as a tension roller. It is also possible to maintain the state of tension of the intermediate transfer belt 24 by arranging a special tension roller in addition to the drive roller 32 and the driven roller 33.

Plurality of image density detecting sensors 25 could be disposed in either one of the turning direction (arrow direction shown in FIG. 1) of the intermediate transfer belt 24 and a width direction orthogonal to the turning direction. At this time, if the image density detecting sensors 25 detect a toner density only at one widthwise side of the intermediate transfer belt 24, the formation of such an image with an inclined toner density distribution in the width direction cannot be dealt with. Therefore, the image density detecting sensors 25 are preferably arranged near the opposite widthwise ends of the intermediate transfer belt 24.

(Secondary Transfer Device 19)

The secondary transfer device 19 is described below with reference to FIGS. 2 and 3.

The secondary transfer device 19 includes the transfer roller 34. Such a transfer roller 34 is so arranged as to be held in contact with a part of the intermediate transfer belt 24 to be held in contact with the circumferential surface of the driven roller 33, this part of the intermediate transfer belt 24 being a folded-back part when the intermediate transfer belt 24 is turned.

Such a transfer roller 34 forms a contact surface by being held in contact with the surface of the intermediate transfer belt 24. The contact surface thus formed by the contact of the transfer roller 34 with the surface of the intermediate transfer belt 24 forms the transfer nip portion N. A position on the surface of the intermediate transfer belt 24 taken up by the contact surface is called a surface contact position.

In the transfer nip portion N, the images transferred to the surface of the intermediate transfer belt 24 are transferred to the transfer material. The secondary transfer device 19 also includes a coil spring (pressing member) 35 for pressing the transfer roller 34 toward the surface of the intermediate transfer belt 24. These transfer roller 34 and coil spring 35 are held in a roller housing 36 to be described later.

In the secondary transfer device 19, the roller housing 36 moves along the circumferential surface of the driven roller 33 by being rotated about a rotary shaft 33*a* of the driven roller 33. If the roller housing 36 moves along the circumferential surface of the driven roller 33, the transfer roller 34 and the coil spring 35 move along the circumferential surface of the driven roller 33. The reason why the transfer roller 34 and the coil spring 35 move along the circumferential surface of the driven roller 33 is described later.

The secondary transfer device 19 also includes a displacing drive part 37 for displacing the surface contact position indicating the position of the surface of the intermediate transfer belt 24 to be held in contact with the transfer roller 34 at least between a first position P1 and a second position P2 different from the first position P1. A driving mode of the displacing drive part 37 is described later. The first and second positions P1, P2 are originally areas in the entire surface of the intermediate transfer belt 24 taken up by the contact surfaces. However, in order to facilitate the description, the first and second positions P1, P2 are assumed as lines substantially bisecting the lengths of the above contact surfaces in a circumferential direction (circumferential direction of the driven roller 33 and the transfer roller 34).

Further, in the secondary transfer device 19, the transfer material having passed the transfer nip portion N is further conveyed to the fixing device 20 through the second transfer material conveyance path 16B. In the fixing device 20, the images transferred to the transfer material are fixed. The transfer material having the images fixed is guided to a terminal end of the transfer material conveyance path 16B and finally discharged onto a discharge tray 12*a*.

Figure 3:
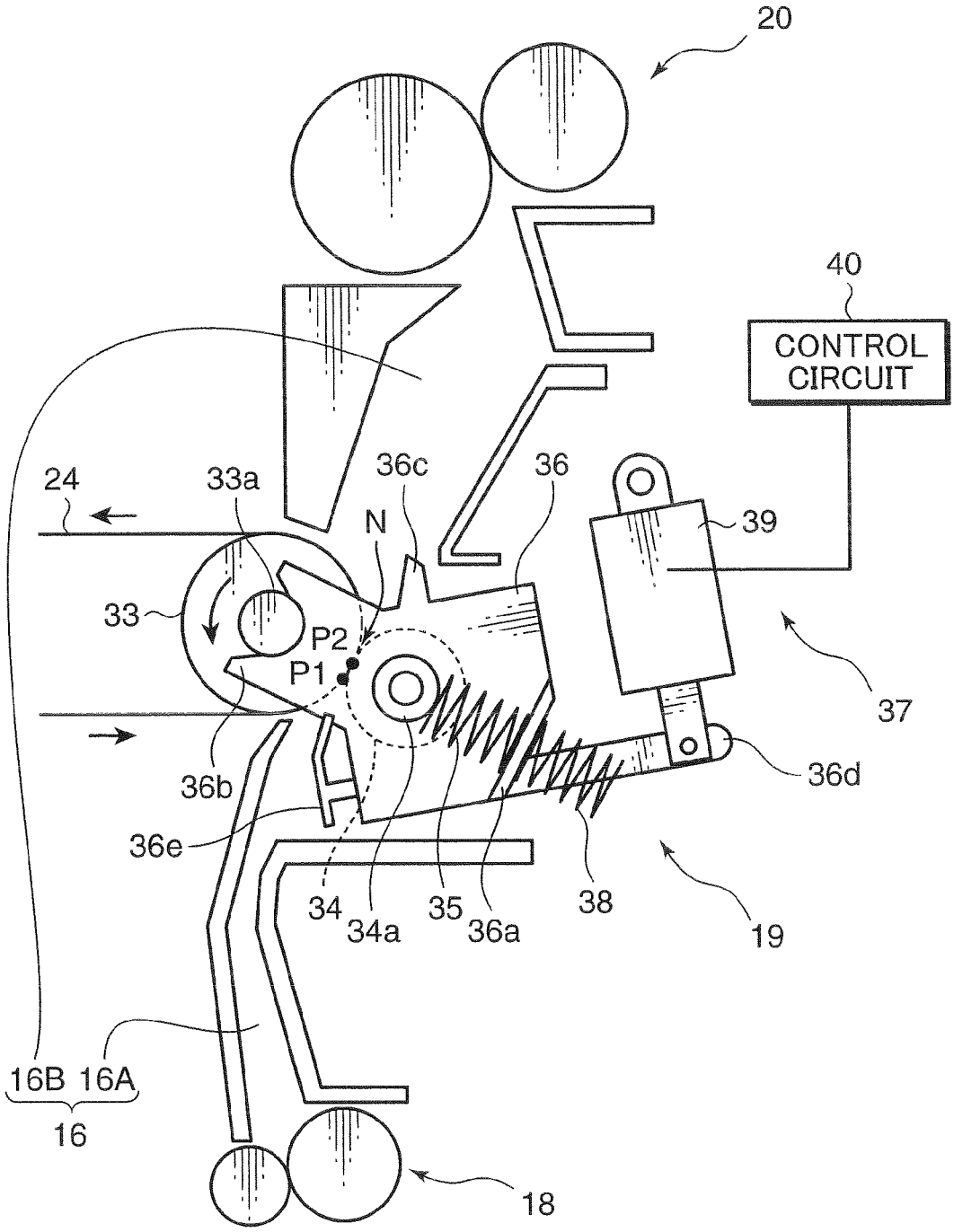
FIG. 3 is a diagram of the exemplary periphery of the secondary transfer device showing a state where the surface contact position corresponding to the position where the transfer nip portion is formed is set to a second position.

In the roller housing 36 shown in FIGS. 2 and 3, one end of the coil spring 35 contacts with a bearing 34*a* of the transfer roller 34. The other end of the coil spring 35 is held in contact with a flange 36*a* of the roller housing 36. The coil spring 35 presses the transfer roller 34 toward the surface of the intermediate transfer belt 24 (strictly speaking, transfer nip portion) by an elastic restoring force thereof. Thus, the transfer roller 34 is pressed against the driven roller 33 by the elastic restoring force of the coil spring 35.

Accordingly, if the roller housing 36 is rotated about the rotary shaft 33*a* of the driven roller 33 to move along the circumferential surface of the driven roller 33, the coil spring 35 is rotated about the rotary shaft 33*a* of the driven roller 33. Thus, the coil spring 35 moves along the circumferential surface of the driven roller 33.

Further, if the coil spring 35 moves along the circumferential surface of the driven roller 33, the transfer roller 34 is rotated about the rotary shaft 33*a* of the driven roller 33. Thus, the transfer roller 34 moves along the circumferential surface of the driven roller 33. Besides the coil spring 35, a compression rubber, a urethane pad, a solenoid or the like can be used as the pressing member.

The roller housing 36 includes a contact piece 36*b* which comes into contact with the rotary shaft 33*a* of the driven roller 33 to rotate the roller housing 36 about the rotary shaft 33*a* of the driven roller 33. By the presence of the contact piece 36*b*, the roller housing 36 can be rotated about the rotary shaft 33*a* of the driven roller 33.

The roller housing 36 includes a transfer material guide 36*c* (downstream side transfer material guide). Such a transfer material guide 36*c* is arranged downstream of the transfer nip portion N in the conveying direction of the transfer material in the roller housing 36.

The leading end of this transfer material guide 36*c* is located in the second transfer material conveyance path 16B so as to come into contact with the underside of the transfer material having the images transferred thereto (transfer material having passed the transfer nip portion N) and a projecting amount thereof into the second transfer material conveyance path 16B changes according to a shifted position of the roller housing 36.

In this embodiment, the projecting amount of the transfer material guide 36*c* into the second transfer material conveyance path 16B changes when the surface contact position is displaced between the first and second positions P1, P2 as the roller housing 36 is rotated (see FIGS. 2 and 3). Thus, the projecting amount of the transfer material guide 36*c* into the second transfer material conveyance path 16B changes depending on whether the surface contact position is at the first position P1 or the second position P2. Accordingly, the path width of the second transfer material conveyance path 16B changes depending on whether the surface contact position is at the first position P1 or the second position P2. Thus, the path width of the second transfer material conveyance path 16B is set at least according to the rigidity of the transfer material, so that the transfer material having passed the transfer nip portion N is stably conveyed toward the fixing device 20.

The roller housing 36 includes an arm portion 36*d* which is rotated about the rotary shaft 33*a* of the driven roller 33*a* as a solenoid 39 to be described later expands and contracts. Such an arm portion 36*d* is rotated in a counterclockwise direction in FIGS. 2 and 3 upon the contraction of the solenoid 39. On the other hand, the arm portion 36*d* is rotated in a clockwise direction in FIGS. 2 and 3 upon the extension of the solenoid 39. The roller housing 36 is rotated as described above as the arm portion 36*d* is rotated in this way.

The roller housing 36 also includes a transfer material guide (upstream side transfer material guide) 36*e* arranged upstream of the transfer nip portion N in the conveying direction of the transfer material. Such a transfer material guide 36*e* is mounted on the roller housing 36. The transfer material guide 36*e* may also be integrally formed with the roller housing 36.

The leading end of the transfer material guide 36*e* is located in the first transfer material conveyance path 16A so as to come into contact with the underside of the transfer material before passing the transfer nip portion N and a projecting amount thereof into the first transfer material conveyance path 16A changes depending on whether the surface contact position is at the first position P1 or at the second position P2.

Such a transfer material guide 36*e* is rotated in the counterclockwise direction as the roller housing 36 is rotated in the counterclockwise direction shown in FIGS. 2 and 3 about the rotary shaft 33*a* of the driven roller 33. Thus, the transfer material guide 36*e* moves in a direction retracted from the first transfer material conveyance path 16A. Accordingly, a conveyance load acting from the pair of registration rollers 18 to the transfer nip portion N is reduced when the surface contact position is set to the second position P2. Therefore, a pasteboard as a transfer material can be suitably passed through the transfer nip portion N.

The transfer material guide 36*e* is also rotated in the clockwise direction as the roller housing 36 is rotated in the clockwise direction in FIGS. 2 and 3 about the rotary shaft 33*a* of the driven roller 33. Thus, the transfer material guide 36*e* moves to a proper position close to the first transfer material conveyance path 16A. Accordingly, when the surface contact position is set to the first position P1, there is less likelihood of such a phenomenon that discharge occurs between the image bearing member and the transfer material upon the passage of a plain paper as the transfer material through the transfer nip portion N and the toner on the surface of the image bearing member is scattered to the periphery of an original transfer position without being transferred to the original transfer position. By suppressing abnormal discharge which could occur between the transfer material and the transfer roller 34, there is less likelihood of such a phenomenon (so-called white spots phenomenon) that toner untransferred parts appear in dots on the transfer material having the images transferred thereto.

Further, a rear side of the roller housing 36 is entirely energized toward the rotary shaft 33*a* of the driven roller 33 by a coil spring 38.

The transfer material guides 36*c* and 36*e* may be integral to the roller housing 36. The transfer material guides 36*c* and 36*e* may be separate from the roller housing 36. Further, the transfer material guides 36*c* and 36*e* may be rotated independently of the rotation of the roller housing 36.

In other words, the transfer material guides 36*c* and 36*e* may be displaced in opposite directions as the roller housing 36 is rotated. Specifically, when the roller housing 36 is rotated in the counterclockwise direction in FIG. 3 about the rotary shaft 33*a* of the driven roller 33 as shown in FIG. 3, the transfer material guide 36*c* is so rotated as to increase the projecting amount into the second transfer material conveyance path 16B. At this time, the transfer material guide 36*e* is so rotated as to decrease the projecting amount into the first transfer material conveyance path 16A.

On the other hand, when the roller housing 36 is rotated in the clockwise direction in FIG. 2 about the rotary shaft 33*a* of the driven roller 33 as shown in FIG. 2, the transfer material guide 36*c* is so rotated as to decrease the projecting amount into the second transfer material conveyance path 16B. At this time, the transfer material guide 36*e* is so rotated as to increase the projecting amount into the first transfer material conveyance path 16A. In this way, the path widths of the first and second transfer material conveyance paths 16A, 16B can be set by the displacements of the transfer material guides 36*c* and 36*e* in the opposite directions.

Although the contact piece 36*b* directly comes into contact with the rotary shaft 33*a* in this embodiment, it may come into contact with a bearing (not shown) holding the rotary shaft 33*a*.

The displacing drive part 37 includes the solenoid 39 having one end coupled to the arm portion 36*d* and the other end supported on an internal frame (not shown) of the printer main body 12 or the like, and a control circuit 40 for controlling the driving of the solenoid 39.

The solenoid 39 is driven to expand and contract by the control of the control circuit 40, thereby displacing the surface contact position described above between the first position P1 (see, for example, FIG. 2) and the second position (see, for example, FIG. 3).

If a transfer sheet is a pasteboard, the transfer roller 34 is rotated by a specified amount toward a downstream side in the conveying direction of the transfer sheet about the rotary shaft 33*a* of the driven roller 33. Thus, the surface contact position could be displaced toward the second position P2 (pasteboard position) shown in FIG. 3. Thus, the transfer material conveyance path 16 from the pair of registration rollers 18 to the transfer nip portion N becomes substantially straight.

On the other hand, if the solenoid 39 expands as shown in FIG. 2, the roller housing 36 is rotated in the clockwise direction in FIGS. 2 and 3 about the rotary shaft 33*a* of the driven roller 33. Thus, the transfer roller 34 is rotated in the clockwise direction about the rotary shaft 33*a* of the driven roller 33 as the roller housing 36 is rotated. As a result, the surface contact position is displaced from the second position P2 to the first position P1.

(Control Circuit 40)

The control circuit 40 obtains environment information on an execution of the image forming process and controls the driving of the displacing drive part 37.

Figure 4:
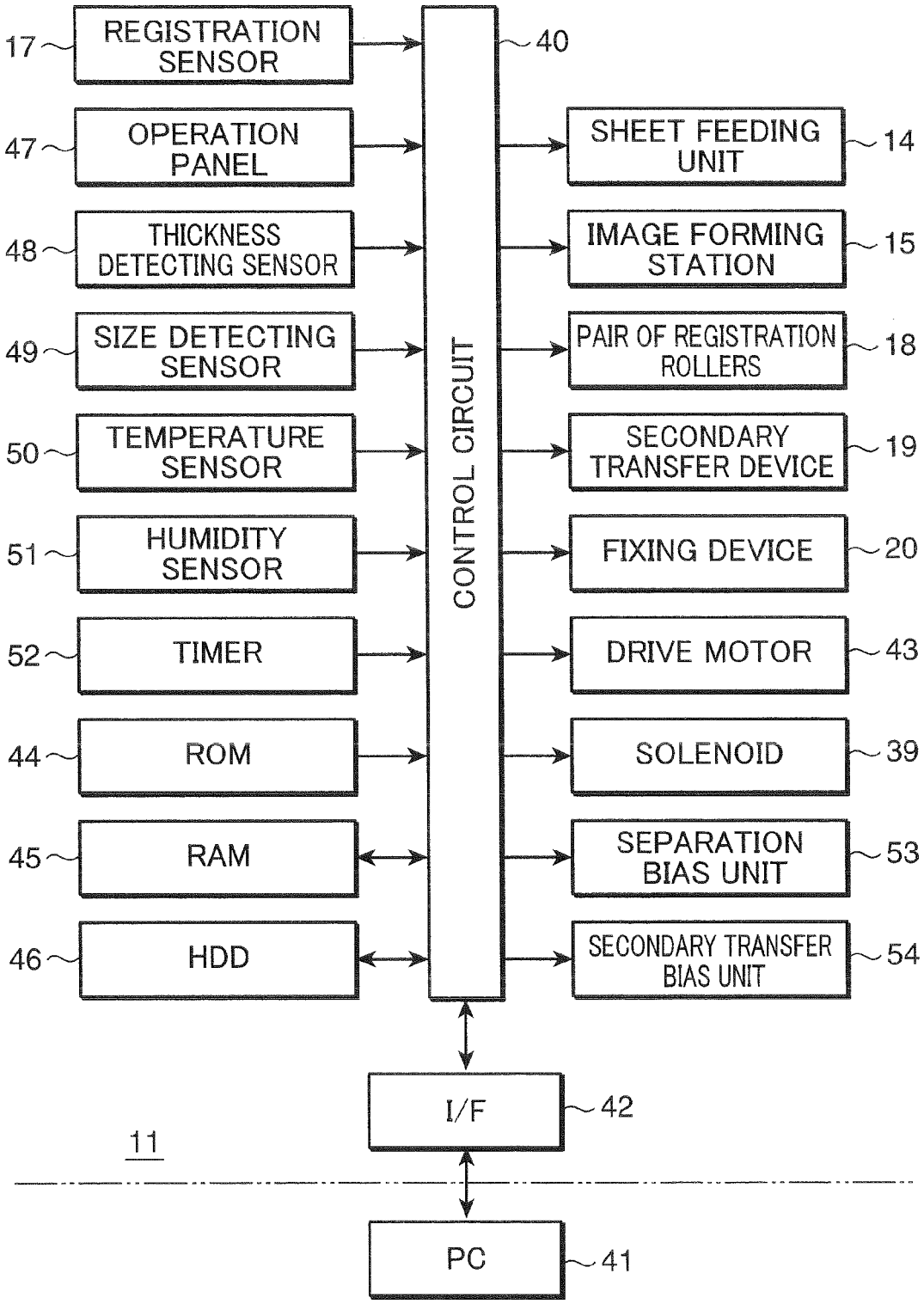
FIG. 4 is a block diagram showing the image forming apparatus according to the embodiment of the invention.

As shown in FIG. 4, the control circuit 40 controls the registration sensor 17, an operation panel 47, a thickness detecting sensor 48, a size detecting sensor 49, a temperature sensor 50, a humidity sensor 51, a timer 52, a ROM 44, a RAM 45, a HDD 46, the sheet feeding unit 14, the image forming station 15, the pair of registration rollers 18, the secondary transfer device 19, the fixing device 20, a drive motor 43, the solenoid 39, a separation bias unit 53, a secondary transfer bias unit 54 and an interface 42.

The control circuit 40 receives print data outputted from a personal computer 41 or the like via the interface 42. Then, the control circuit 40 controls the driving and the like of the sheet feeding unit 14, the image forming station 15, the secondary transfer device 19, the fixing device 20 and the drive motor 43 for the drive roller 32. The control circuit 40 also calibrates development conditions such as toner supplies to the respective developing devices 23 and bias voltages to be applied to the developing devices 23, exposure conditions such as charging biases to be applied to the charging devices 28 and laser power of the exposing device 27, erasing light quantities of the discharging devices 31 in addition to controlling the above various driving systems based on various control programs relating to the image forming process in general stored in the ROM 44.

A control program for the transfer roller 34 is stored in the ROM 44. Such a ROM 44 constitutes a microcomputer together with the control circuit 40 for implementing the control program for the transfer roller 34.

Further, the control circuit 40 temporarily saves image data used to perform the image forming process in a storage such as the RAM 45 or the HDD 46 different from the ROM 44. The control circuit 40 also temporarily saves print conditions included in the print data and set conditions (e.g. enlargement/reduction, number of copies, etc.) set by operating the operation panel 47 in the RAM 45. Such set conditions are erased by being cleared using the operation panel 47 or the count-up of the timer 52.

The control circuit 40 also saves a detection result from the image density detecting sensors 25 in the RAM 45 or the HDD 46. The control circuit 40 controls the driving of the pair of registration rollers 18 based on a transfer material detection timing from the registration sensor 17. Further, the control circuit 40 controls various driving systems including the solenoid 39 based on at least one of transfer material thickness information from the transfer material thickness detecting sensor 48 arranged near the sheet feeding unit 14, transfer material size information from the size detecting sensor 49, temperature information indicating in-apparatus temperature in the printer main body 12 from the temperature sensor 50, humidity information indicating in-apparatus humidity in the printer main body 12 from the humidity sensor 51 and environment information outputted from the timer 52 and the like.

The control circuit 40 assumes, for example, set data inputted by the operation of the operation panel 47 or set data included in the print data as the environment information on the execution of the image forming process. Here, the environment information is at least one of information indicating a volume resistance value of the transfer material, information indicating surface smoothness of the transfer material, information indicating in-apparatus temperature, information indicating in-apparatus humidity, sheet feed information indicating a duplex sheet feed to have images transferred to both sides or a simplex sheet feed to have an image transferred to one side and print image information indicating the type of an image.

These pieces of information are assumed as the environment information for the following reasons.

Transfer Material Thickness Information

If the transfer material is a pasteboard, a conveyance load in the transfer material conveyance path 16 increases. If the conveyance load increases, the conveying speed changes before and after the rear of the transfer material passes the registration rollers as described above. At this time, the phenomenon of reducing the equal magnification in the conveying direction (sub scanning direction) and the phenomenon of not transferring the toner in parts other than the edge parts in the image transferred to the transfer material are likely to occur as described above. Further, the phenomenon in which the image is not properly transferred to the transfer material on the near rear of the transfer material is likely occur thereto. Conversely, if the transfer material is a thin paper, the phenomenon of making it more difficult for the transfer material to separate from the intermediate transfer belt 24 is likely to occur.

Transfer Material Size Information

As a pasteboard has a larger size, resistance hindering the conveyance of the transfer material in the transfer material conveyance path 16 becomes larger.

Sheet Feed Information

As compared with the simplex sheet feed, an electrical resistance value of the transfer material increases in the duplex sheet feed, whereby charged amounts of the transfer material and the toner by the transfer bias increase. At this time, the transfer material is unlikely to be easily separated from the intermediate transfer belt 24 and the image is unlikely to be properly transferred to the transfer material. Further, the phenomenon (so-called white spot phenomenon) in which toner untransferred parts appear in dots is likely to occur on the transfer material having the image transferred thereto. In the case of using a relatively thick transfer material, the phenomenon in which the rear of the transfer material leaps up in the transfer material conveyance path 16 is likely to occur in the duplex sheet feed. Further, the phenomenon of displacing the transfer position of the image to the transfer material is likely to occur in the duplex sheet feed.

Temperature Information or Humidity Information

In a low-temperature or low-humidity environment, an electrical resistance value of the transfer material is likely to increase. Thus, the transfer material is unlikely to be easily separated from the intermediate transfer belt 24. Further, the image is unlikely to be properly transferred to the transfer material. Further, the phenomenon (so-called white spot phenomenon) in which toner untransferred parts appear in dots is likely to occur on the transfer material having the image transferred thereto.

Print Image Information

In the case of a character image, the following phenomena are likely to occur. For example, there is more likelihood of the phenomenon in which discharge occurs between the image bearing member and the transfer material and the toner on the surface of the image bearing member is scattered to the periphery of an original transfer position without being transferred to the original transfer position. Further, in the image transferred to the transfer material, the toner in parts other than edge parts is not transferred in more likelihood.

In the case of a solid image or a halftone image, the following phenomena are likely to occur. For example, there is more likelihood of such a phenomenon that a toner untransferred part appears over a specific area on the transfer material having the image transferred thereto. Further, there is more likelihood of the phenomenon (so-called white spot phenomenon) in which toner untransferred parts appear in dots on the transfer material having the image transferred thereto. Further, electrostatic scattering is likely to occur.

In the case of a line image, for example, the toner in parts other than edge parts are unlikely to be transferred on the image transferred to the transfer material. There is more likelihood of the phenomenon in which discharge occurs between the image bearing member and the transfer material and the toner on the surface of the image bearing member is scattered to the periphery of an original transfer position without being transferred to the original transfer position. In the case of a blank image, the phenomenon of making it more difficult to separate the transfer material from the intermediate transfer belt 24 is likely to occur.

Surface Smoothness Information

If the transfer material has poor surface smoothness, the secondary transfer is difficult to perform. For example, the following phenomenon is likely to occur. Specifically, since the transfer bias does not uniformly act on the transfer material surface, there are toner strongly attracted to the transfer material from the surface of the image bearing member and toner not strongly attracted to the transfer material from the surface of the image bearing member. Thus, a phenomenon of not uniformly transferring the toner to the transfer material occurs.

Further, concave portions and convex portions are present on the surface of the transfer material with poor surface smoothness. Toner is easily transferred to the convex portions of the surface of the uneven transfer material while being less easily transferred to the concave portions. Thus, the phenomenon of not uniformly transferring the toner to the transfer material occurs.

These problems are unlikely to occur if the pressing force of transfer roller 34 for pressing the intermediate transfer belt 24 becomes stronger.

FIG. 5 shows an example of switching to the first position P1 and the second position P2 by the control circuit 40 upon obtaining the environment information. The following example is the one in the case where there is one piece of environment information. If a plurality of pieces of environment information hold true, position switching is controlled based on these pieces of information. For example, a judgment criterion (large, small) on the transfer material size differs depending on performance, layout and the like such as the distinction of the color printer 11 as to whether or not the color printer 11 is a large-size high-speed apparatus or a small-size low-speed apparatus.

Figure 6:
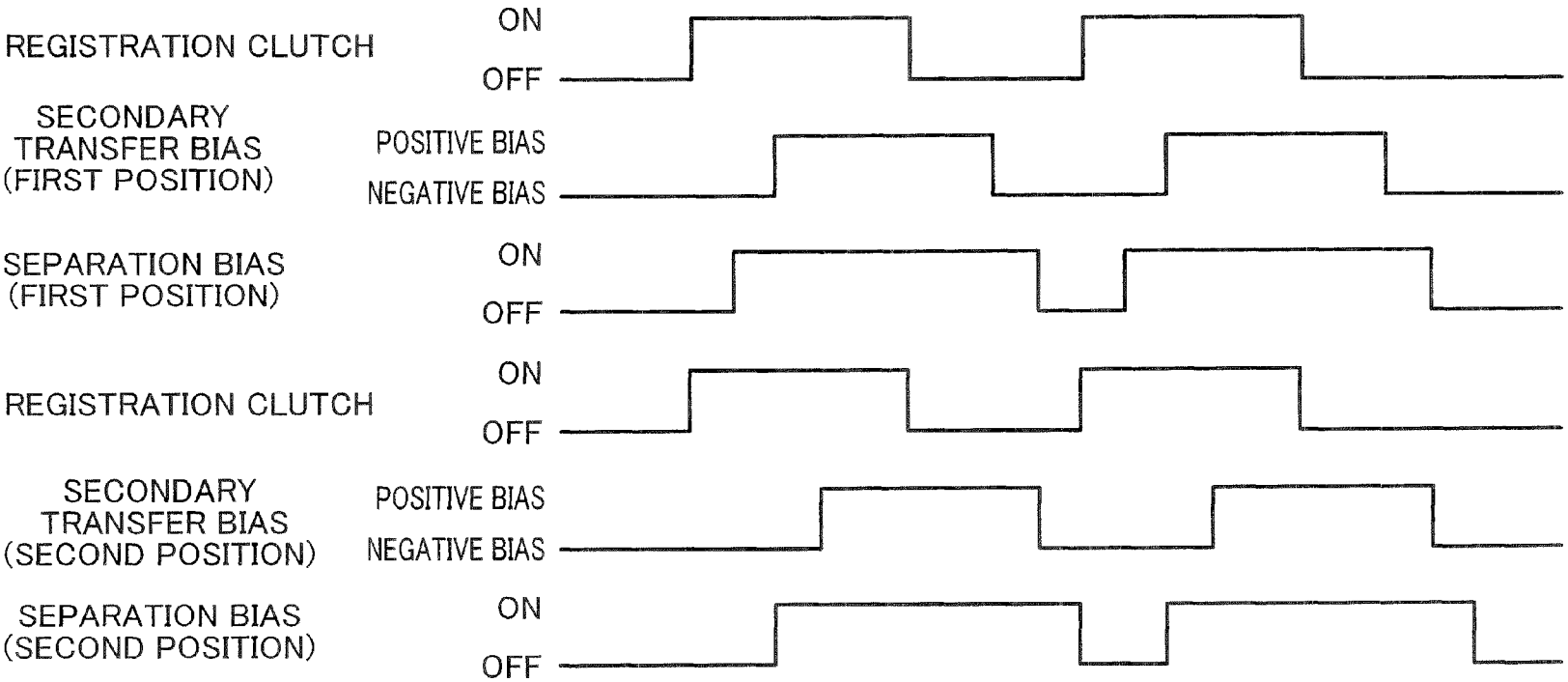
FIG. 6 is a chart showing bias application timings for applying transfer biases and separation biases.

Further, the control circuit 40 executes the following control upon displacing the surface contact position described above between the first position P1 and the second position P2 by controlling the driving of the displacing drive part 37. In other words, the control circuit 40 executes such a control as to shift ON/OFF timings of the transfer bias unit 54 and the separation bias unit 53 by a period corresponding to a moved amount of the transfer roller 34 (rotated amount of the transfer roller 34 about the rotary shaft 33*a* of the driven roller 33) as shown in FIG. 6.

Thus, regardless of whether the surface contact position is set to the first position P1 or to the second position P2, a transfer bias is applied when the transfer material reaches the transfer nip portion N and a separation bias is applied after the image is transferred to the transfer material.

Accordingly, regardless of whether the surface contact position is set to the first position P1 or to the second position P2, it can be satisfactorily realized to transfer the image to the transfer material in the transfer nip portion N and to separate the transfer material having the image transferred thereto in the transfer nip portion N from the intermediate transfer belt 24.

In the above construction, the control circuit 40 causes the solenoid 39 to expand and stops the roller housing 36 substantially at a proper position as shown in FIG. 2 and performs the conveyance, image transfer and image fixing of the transfer material in this state with reference to other pieces of environment information such as the in-apparatus temperature if the obtained environment information is the one relating to plain paper.

Further, the control circuit 40 causes the solenoid 39 to contract and stops the roller housing 36 substantially at the pasteboard position as shown in FIG. 3 with reference to other pieces of environment information such as the in-apparatus temperature if the obtained environment information is the one relating to pasteboard. The control circuit 40 performs the conveyance, image transfer and image fixing of the transfer material in this state.

The above processings are executed by the control circuit 40. Thus, the surface contact position is set to the second position P2 shown in FIG. 3 if the transfer material is a pasteboard.

This second position P2 is located more downstream than the first position P1 shown in FIG. 2 in the conveying direction of the transfer material along the circumferential surface of the driven roller 33. Thus, a direction from the pair of registration rollers 18 to the second position P2 becomes straighter than a direction from the pair of registration rollers 18 to the first position P1 in the first transfer material conveyance path 16A.

Figure 7:
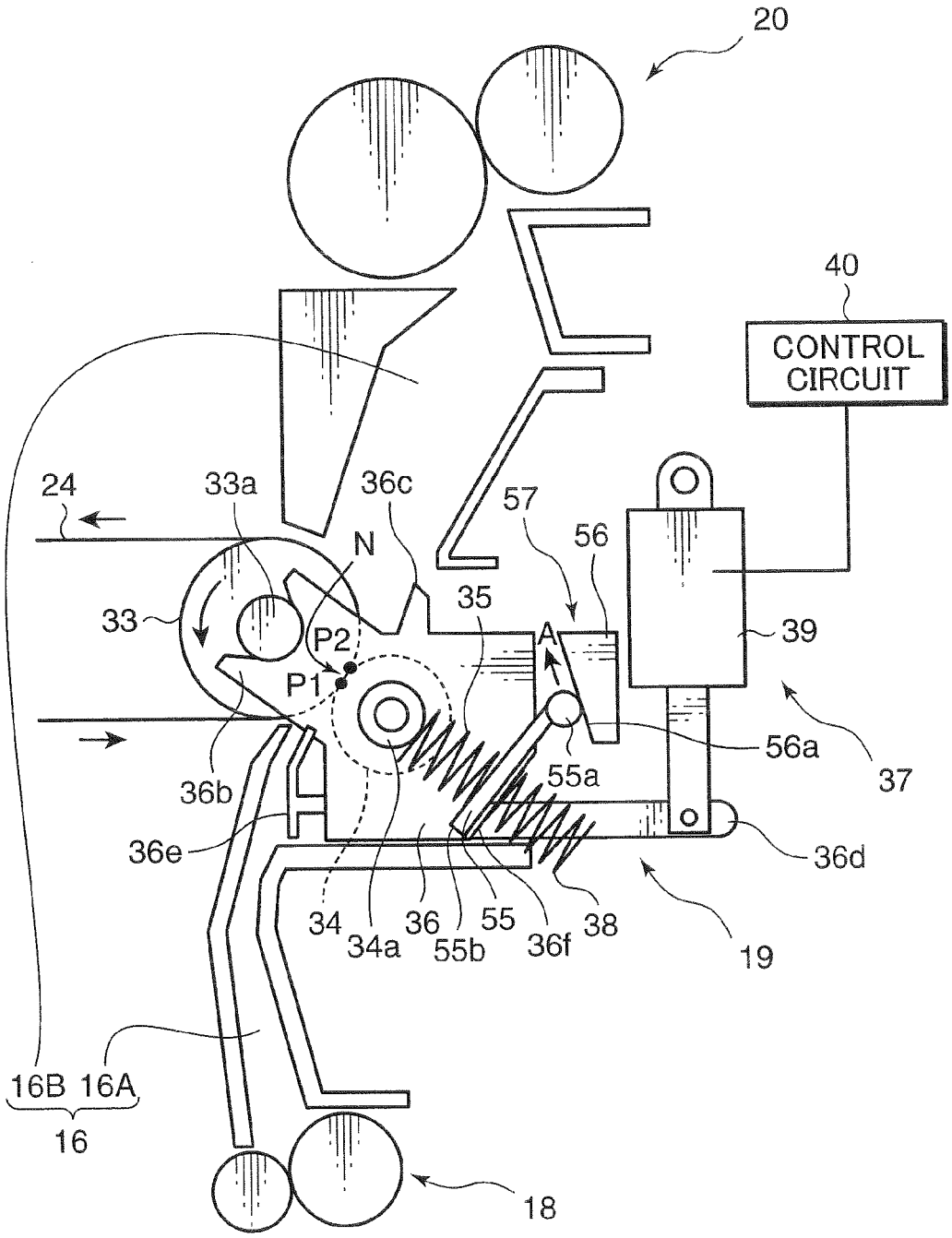
FIG. 7 is a diagram of another exemplary periphery of the secondary transfer device showing the state where the surface contact position corresponding to the position where the transfer nip portion is formed is set to the first position.
Figure 8:
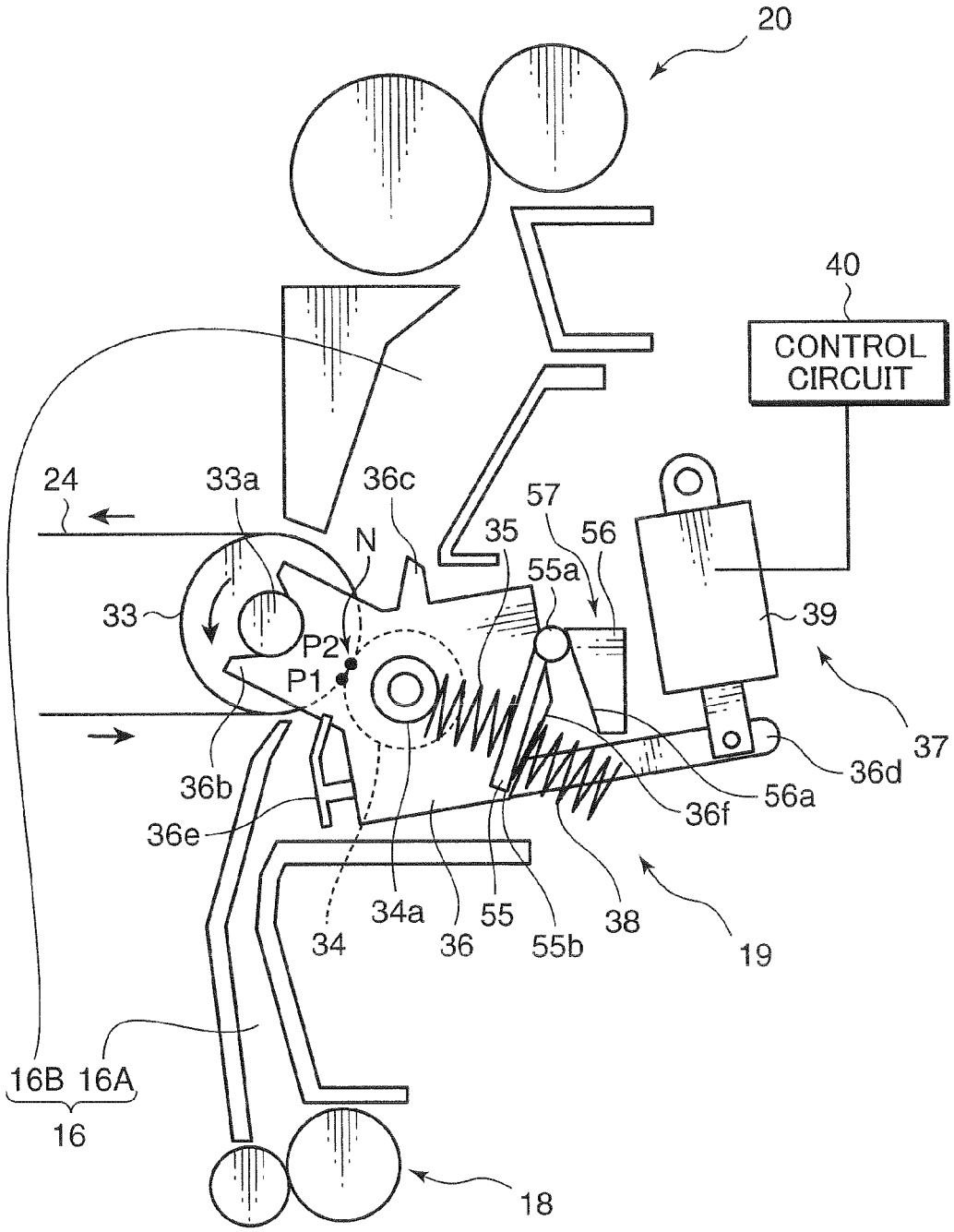
FIG. 8 is a diagram of another exemplary periphery of the secondary transfer device showing the state where the surface contact position corresponding to the position where the transfer nip portion is formed is set to the second position.

The following embodiment is also possible. For example, as shown in FIGS. 7 and 8, a contact member 55 which comes into contact with one end of the coil spring 35 is provided instead of the flange 36*a*. In such a contact member 55, one end (hereinafter, contact portion) 55*a* is in contact with a supporting member 56 fixed in the printer main body 12 and the other end 55*b* is in contact with an inclined surface 36*f* of the roller housing 36.

In such a contact member 55, the contact portion 55*a* moves along the supporting member 56 and the other end 55*b* moves along the inclined surface 36*f* of the roller housing 36 as the roller housing 36 is rotated according to the extension or contraction of the solenoid 39. Detailed movement modes of the contact portion 55*a* and the other end 55*b* are described later.

In such an embodiment, a pressing force adjusting member 57 is constituted by the following elements. Specifically, the pressing force adjusting member 57 includes the contact member 55 that comes into contact with one end of the coil spring 35, the supporting member 56 for displaceably supporting the contact member 55 and a guide surface 56*a* formed on the supporting member 56 for changing a force exerted from the contact member 55 to the coil spring 35 between the first position P1 and the second position P2.

At this time, the inclination of the guide surface 56*a* is set such that a pressing force of the transfer roller 34 at the second position P2 is stronger than that of the transfer roller 34 at the first position P1. A direction of inclination may be reversed to set the pressing force at the second position P2 weaker than the one at the first position P1.

In such a pressing force adjusting member 57, the contact member 55 moves as follows when the roller housing 36 is rotated in a counterclockwise direction in FIGS. 7 and 8 by the contraction of the solenoid 39. Specifically, in the contact member 55, the contact portion 55*a* moves in a direction of arrow A along the guide surface 56*a*. At this time, the entire contact member 55 moves in a direction toward the transfer roller 34 since the other end 55*b* of the contact member 55 is held at a corner of the roller housing 36. Thus, the coil spring 35 is compressed upon receiving a force acting in a direction opposite to a energizing direction from the contact member 55.

In this way, the coil spring 35 is compressed upon receiving the force acting in the direction opposite to the energizing direction as the contact member 55 moves. Thus, an elastic restoring force of the coil spring 35 becomes larger. By increasing the elastic restoring force in this way, the pressing force of the transfer roller 34 for pressing the intermediate transfer belt 24 increases.

Thus, the pressing force of the transfer roller 34 for pressing the intermediate transfer belt 24 becomes larger, since the elastic restoring force of the coil spring 35 is larger when the surface contact position is at the second position P2 as shown in FIG. 8 as compared with the case where the surface contact position is at the first position P1 as shown in FIG. 7

Such a pressing force is preferably a force not exceeding a pressing force required to convey the transfer material. Then, a reduction in equal magnification in the conveying direction (sub scanning direction) can be suppressed. Further, the occurrence of such a state where toner in parts other than edge parts is not transferred in the image transferred to the transfer material is suppressed. Further, since the deformation of the transfer roller 34 is suppressed, the occurrence of the phenomenon of making it more difficult to separate the transfer material from the intermediate transfer belt 24 is also suppressed.

The present invention is applicable to image forming apparatuses in general such as copiers and facsimile machines.

The present invention is also applicable to primary transfer device structures in the relationship of the photoconductive drums 22 and the intermediate transfer belt 24. The present invention is further applicable to a primary transfer device structure free from secondary transfer in an image forming apparatus provided with a photoconductive drum as an image bearing member such as a monochromatic image forming apparatus.

Figure 9:
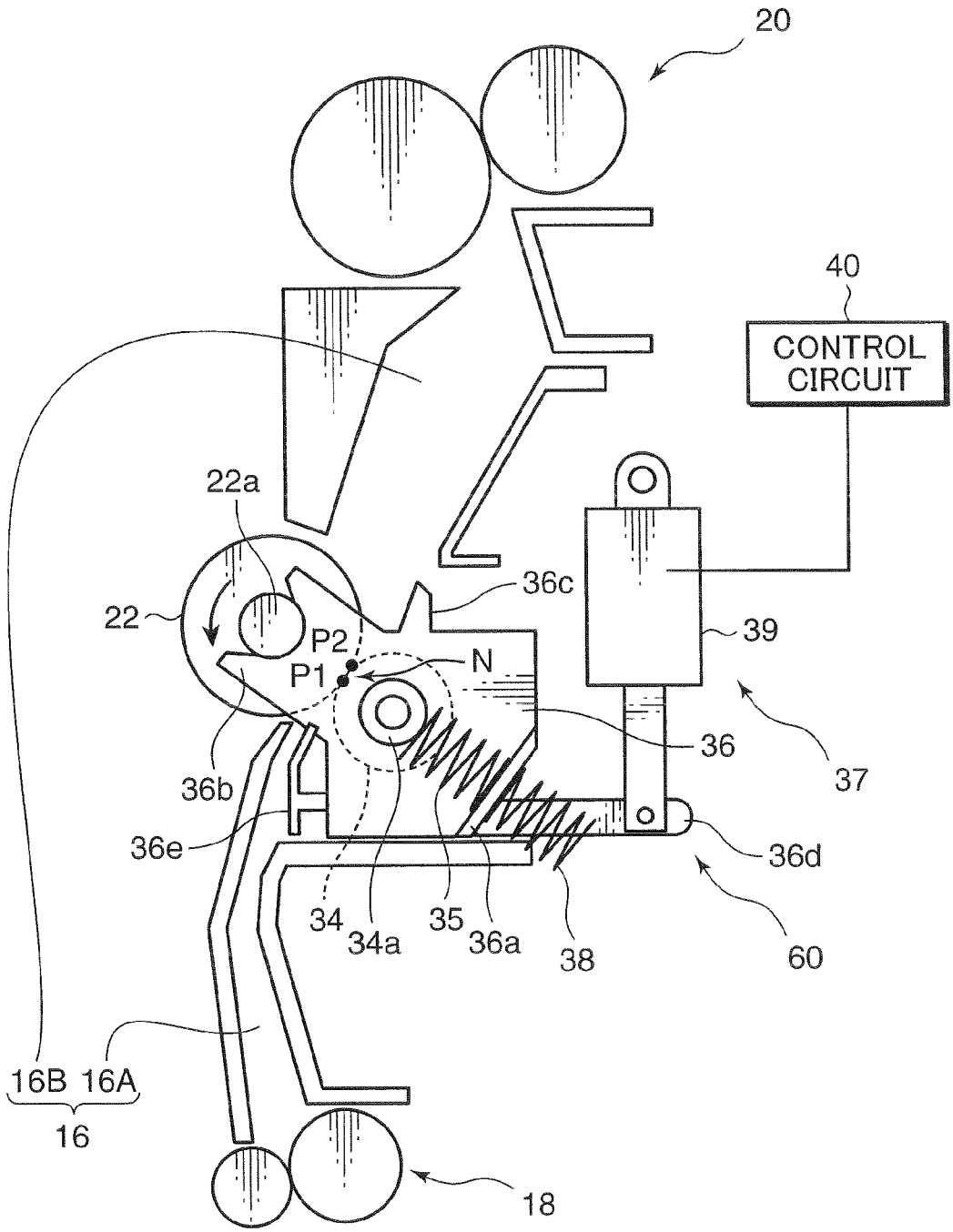
FIG. 9 is a diagram of an application example of the invention to a primary transfer device showing a state where a surface contact position corresponding to a position where a transfer nip portion is formed is set to a first position.
Figure 10:
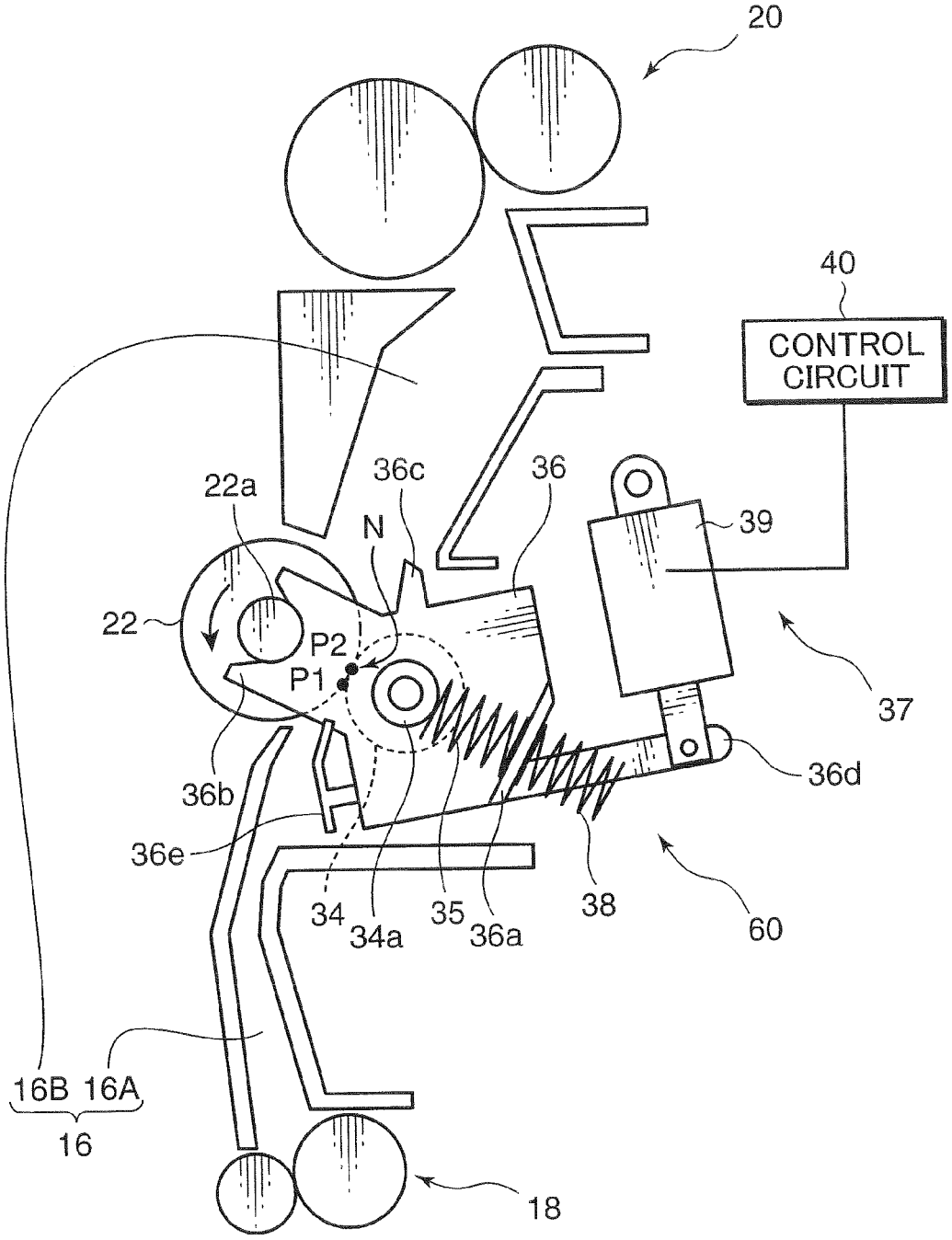
FIG. 10 is a diagram of the application example of the invention to the primary transfer device showing a state where the surface contact position corresponding to the position where the transfer nip portion is formed is set to a second position.

FIGS. 9 and 10 show an application example of the present invention to a primary transfer device structure. In FIG. 9, functions of constituent elements other than those described below are the same as those of the constituent elements shown in FIG. 2. Thus, these are identified by the same reference numerals as those shown in FIG. 2. In FIG. 10, functions of constituent elements other than those described below are the same as those of the constituent elements shown in FIG. 3. Thus, these are identified by the same reference numerals as those shown in FIG. 3.

In a primary transfer device 60 shown in FIGS. 9 and 10, a transfer roller 34 is arranged in contact with a surface of a photoconductive drum 22. Devices necessary for image formation such as a charging device, an exposing device and a developing device are present around the photoconductive drum 22.

The photoconductive drum 22 has the following functions as the image bearing member.

In the primary transfer device 60, the transfer roller 34 is held in contact with the circumferential surface of the photoconductive drum 22 to form a contact surface. The contact surface thus formed by the contact of the transfer roller 34 with the circumferential surface of the photoconductive drum 24 forms a transfer nip portion N. A position on the circumferential surface of the photoconductive drum 24 taken up by the above contact surface is called a surface contact position.

In the transfer nip portion N, an image formed on the photoconductive drum 22 is transferred to a transfer material. Further, a coil spring 35 energizes the transfer roller 34 to press it toward the photoconductive drum 22 in the primary transfer device 60.

In the primary transfer device 60, a displacing drive part 37 displaces the surface contact position indicating a position of the circumferential surface of the photoconductive drum 22 held in contact with the transfer roller 34 at least between a first position P1 and a second position P2 different from the first position P1. Here, the first and second positions P1, P2 are originally areas in the entire circumferential surface of the photoconductive drum 22 taken up by the contact surfaces. However, in order to facilitate the description, the first and second positions P1, P2 are assumed as lines substantially bisecting the lengths of the above contact surfaces in a circumferential direction (circumferential direction of the photoconductive drum 22 and the transfer roller 34).

In the primary transfer device 60, a roller housing 36 includes a contact piece 36*b* which comes into contact with a rotary shaft 22*a* of the photoconductive drum 22 to rotate the roller housing 36 about the rotary shaft 22*a* of the photoconductive drum 22. By the presence of such a contact piece 36*b*, the roller housing 36 can be rotated about the rotary shaft 22*a* of the photoconductive drum 22 to move along the circumferential surface of the photoconductive drum 22.

A rear side of such a roller housing 36 is entirely energized toward the rotary shaft 22*a* of the photoconductive drum 22 by a coil spring 38.

A solenoid 39 is driven to expand and contract by the control of a control circuit 40 to rotate the roller housing 36, whereby the surface contact position is displaced between the first position P1 (see, for example, FIG. 9) and the second position P2 (see, for example, FIG. 10).

Figure 11:
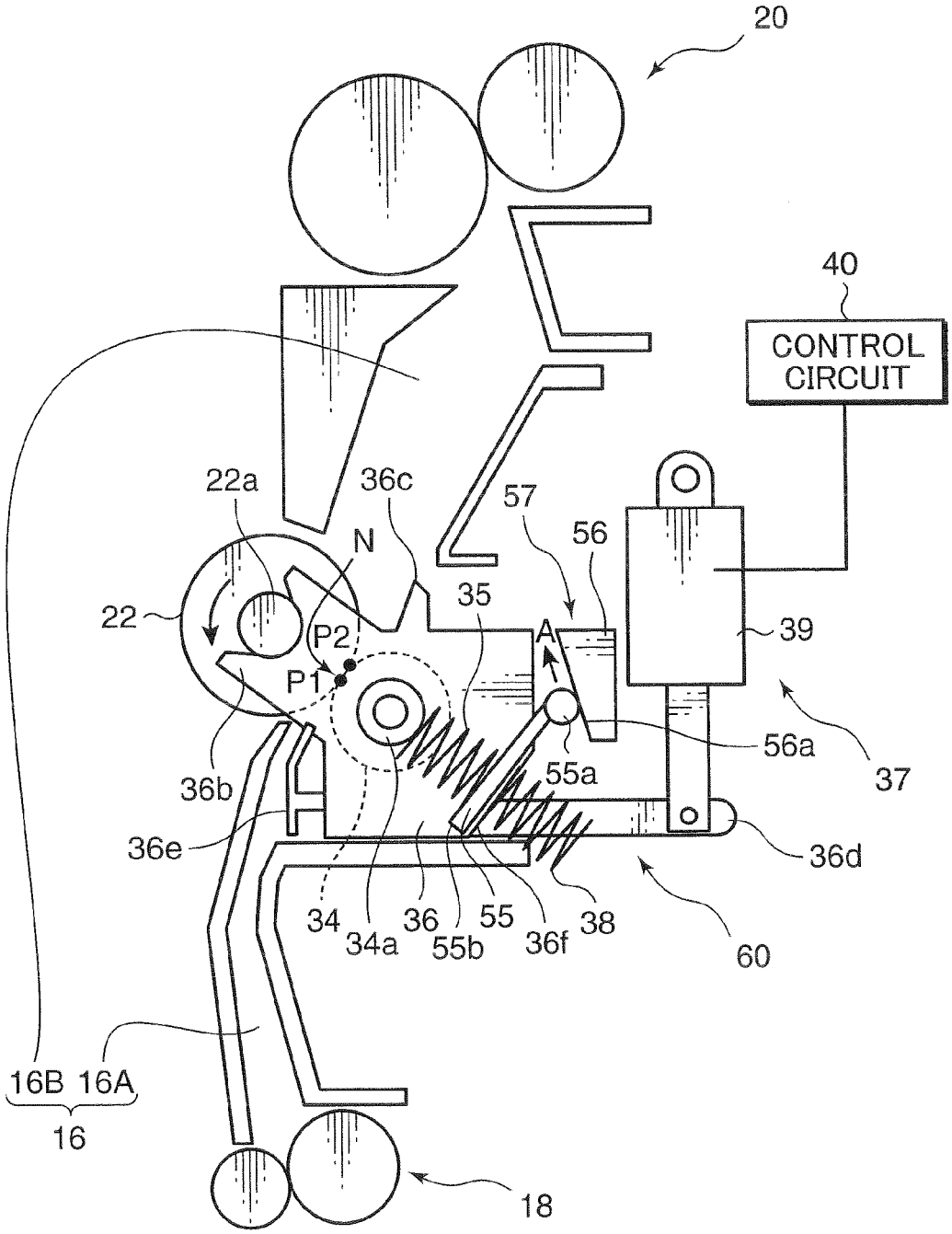
FIG. 11 is a diagram of another application example of the invention to the primary transfer device showing the state where the surface contact position corresponding to the position where the transfer nip portion is formed is set to the first position.
Figure 12:
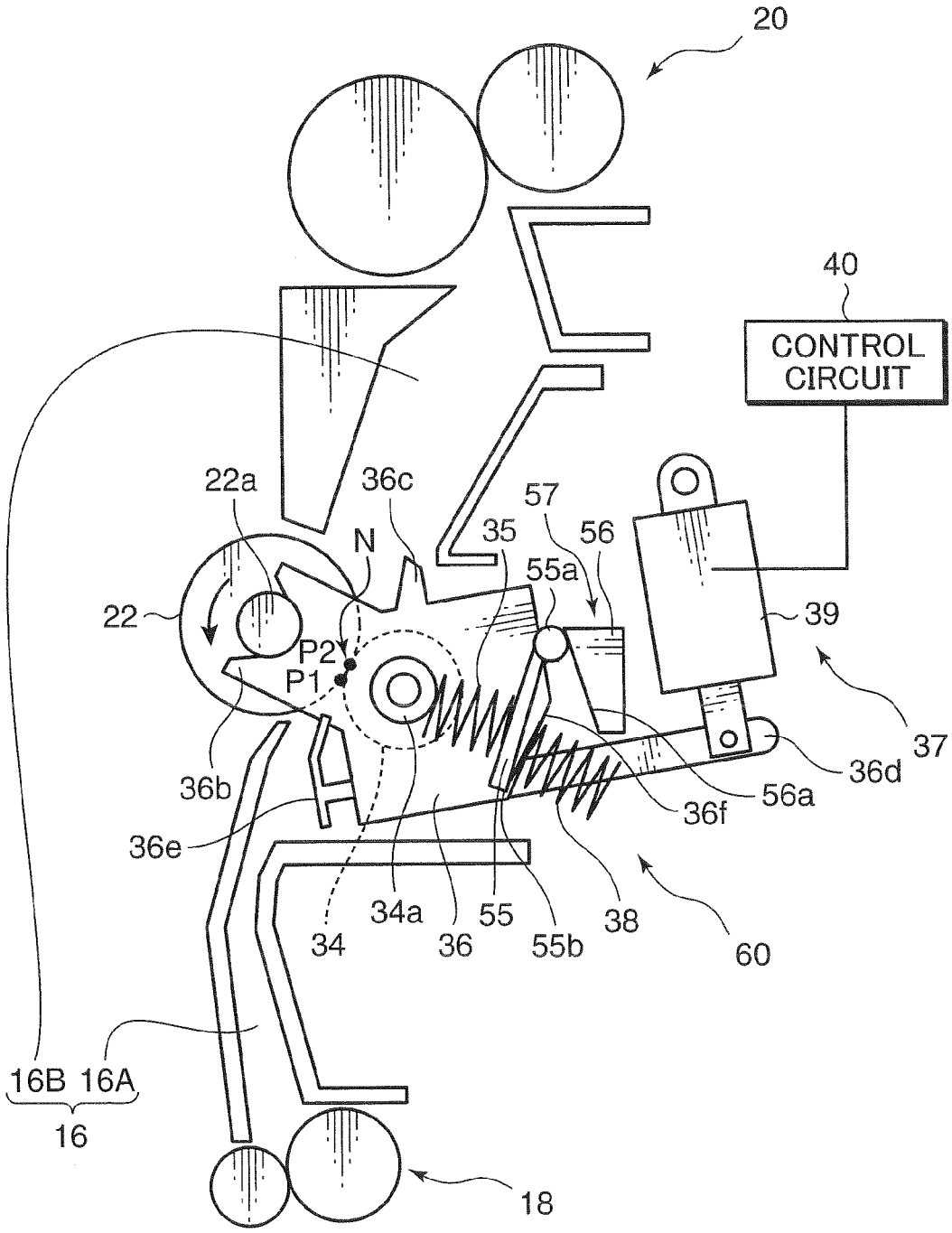
FIG. 12 is a diagram of another application example of the invention to the primary transfer device showing the state where the surface contact position corresponding to the position where the transfer nip portion is formed is set to the second position.

FIGS. 11 and 12 show another application example of the present invention to a primary transfer device structure. In FIG. 11, functions of constituent elements other than those described below are the same as those of the constituent elements shown in FIG. 7. Thus, these are identified by the same reference numerals as those shown in FIG. 7. In FIG. 12, functions of constituent elements other than those described below are the same as those of the constituent elements shown in FIG. 8. Thus, these are identified by the same reference numerals as those shown in FIG. 8.

In a primary transfer device 60 shown in FIGS. 11 and 12, a pressing force adjusting member 57 operates as follows.

In the pressing force adjusting member 57, a contact member 55 moves as described below when a roller housing 36 is rotated in a counterclockwise direction in FIGS. 11 and 12 by the contraction of a solenoid 39. Specifically, in the contact member 55, a contact portion 55*a* moves in a direction of arrow A along a guide surface 56*a*. At this time, the entire contact member 55 moves in a direction toward the transfer roller 34 since the other end 55*b* of the contact member 55 is held at a corner of the roller housing 36. Thus, a coil spring 35 is compressed upon receiving a force acting in a direction opposite to a energizing direction from the contact member 55.

In this way, the coil spring 35 is compressed upon receiving the force acting in the direction opposite to the energizing direction as the contact member 55 moves. Thus, an elastic restoring force of the coil spring 35 becomes larger. By increasing the elastic restoring force in this way, the pressing force of the transfer roller 34 for pressing the photoconductive drum 22 increases.

Thus, the pressing force of the transfer roller 34 for pressing the photoconductive drum 22 becomes larger, since the elastic restoring force of the coil spring 35 is larger when the surface contact position is at the second position P2 as shown in FIG. 12 as compared with the case where the surface contact position is at the first position P1 as shown in FIG. 11

In the above embodiment, the surface contact position is controlled to be displaced between the first position P1 and the second position P2. However, the surface contact positions are not limited to two positions. For example, the surface contact positions may include a third position different from the first and second positions P1, P2. If the number of the surface contact positions increases, the number of the transfer nip portions N increases and the pressing force of the transfer roller for pressing the surface of either one of the intermediate transfer belt 24 and the photoconductive drum 22 finely changes. Therefore, a transfer better corresponding to the environment information can be realized.

In order to increase the number of the surface contact positions, the displacing drive part 37 may increase the number of stops during the rotation of the roller housing 36. To this end, the number of stops during the extension and contraction of the solenoid 39 may be increased.

The above specific embodiments mainly embrace inventions having the following constructions.

An image forming apparatus according to one aspect of the present invention comprises an image bearing member for transferring an image to a transfer material using a developer; a transfer roller arranged in contact with the circumferential surface of the image bearing member for forming a transfer nip portion; and a displacing drive part for displacing a surface contact position corresponding to a position of the circumferential surface of the image bearing member where the transfer nip portion is formed by the contact of the transfer roller at least to either one of a first position and a second position different from the first position.

According to this construction, the surface contact position corresponding to the position of the circumferential surface of the image bearing member where the transfer nip portion is formed by the contact of the transfer roller is displaced at least to either one of the first position and the second position different from the first position. Thus, it is realized to convey the transfer material and to transfer the image to the transfer material in conformity with a change of a condition such as the thickness of the transfer material.

In the above construction, it is preferable that a pair of registration rollers for controlling a timing of conveying the transfer material in a direction toward the transfer nip portion and a first transfer material conveyance path for conveying the transfer material from the pair of registration rollers to the transfer nip portion are further provided; and that the first transfer material conveyance path becomes straighter when the surface contact position is set to the second position by the displacing drive part than when the surface contact position is set to the first position by the displacing drive part.

According to this construction, when the surface contact position is displaced to the second position, resistance hindering the conveyance of the transfer material along the first transfer material conveyance path is reduced as compared with the case where the surface contact position is displaced to the first position.

In the above construction, the second position is preferably located more downstream than the first position in a conveying direction of the transfer material along the circumferential surface of the image bearing member.

According to this construction, a path direction from the pair of registration rollers to the second position is straighter than a path direction from the pair of registration rollers to the first position in the first transfer material conveyance path.

In the above construction, it is preferable to further comprise a second transfer material conveyance path for further conveying the transfer material having passed the transfer nip portion; and a downstream side transfer material guide which projects into the second transfer material conveyance path in such a manner as to come into contact with one surface of the transfer material having passed the transfer nip portion and whose projecting amount into the second transfer material conveyance path changes depending on whether the surface contact position is at the first position or at the second position.

According to this construction, resistance hindering the conveyance of the transfer material along the second transfer material conveyance path changes in conformity with a change of a condition such as the thickness of the transfer material having passed the transfer nip portion.

In the above construction, it is preferable to further comprise a pair of registration rollers for controlling a timing of conveying the transfer material in a direction toward the transfer nip portion; a first transfer material conveyance path for conveying the transfer material from the pair of registration rollers to the transfer nip portion; and an upstream transfer material guide which projects into the first transfer material conveyance path in such a manner as to come into contact with one surface of the transfer material before passing the transfer nip portion and whose projecting amount into the first transfer material conveyance path changes depending on whether the surface contact position is at the first position or at the second position.

According to this construction, resistance hindering the conveyance of the transfer material along the first transfer material conveyance path changes in conformity with a change of a condition such as the thickness of the transfer material before passing the transfer nip portion.

In the above construction, it is preferable to further comprise a pair of registration rollers for controlling a timing of conveying the transfer material in a direction toward the transfer nip portion; a first transfer material conveyance path for conveying the transfer material from the pair of registration rollers to the transfer nip portion; a second transfer material conveyance path for further conveying the transfer material having passed the transfer nip portion; an upstream transfer material guide which projects into the first transfer material conveyance path in such a manner as to come into contact with one surface of the transfer material before passing the transfer nip portion and whose projecting amount into the first transfer material conveyance path changes depending on whether the surface contact position is at the first position or at the second position; and a downstream side transfer material guide which projects into the second transfer material conveyance path in such a manner as to come into contact with the one surface of the transfer material having passed the transfer nip portion and whose projecting amount into the second transfer material conveyance path changes depending on whether the surface contact position is at the first position or at the second position, the upstream and downstream transfer material guides being displaced in opposite directions.

According to this construction, if the upstream transfer material guide that comes into contact with the one surface of the transfer material before passing the transfer nip portion is so displaced as to decrease the projecting amount into the first transfer material conveyance path, the downstream transfer material guide that comes into contact with the one surface of the transfer material having passed the transfer nip portion projects more into the second transfer material conveyance path.

Thus, the shape of the entire conveyance path made up of the first and second transfer material conveyance paths approximates to a straight shape. Accordingly, if the second position is located more downstream than the first position in the conveying direction of the transfer material, the transfer material can pass substantially straight along the path made up of the first transfer material conveyance path, the transfer nip portion and the second transfer material conveyance path. Therefore, the transfer material can be prevented from being bent while passing along the above path. As a result, a highly rigid transfer material can be stably conveyed.

In the above construction, it is preferable that a pressing member for pressing the transfer roller toward the image bearing member and a roller housing for holding the transfer roller and the pressing member and moving the transfer roller along the circumferential surface of the image bearing member by moving along the circumferential surface of the image bearing member are further provided; and that the displacing drive part displaces the surface contact position between the first position and the second position along the circumferential surface of the image bearing member by moving the roller housing along the circumferential surface of the image bearing member.

According to this construction, the displacing drive part can easily displace the surface contact position between the first position and the second position along the circumferential surface of the image bearing member.

In the above construction, it is preferable that the image bearing member is a photoconductive drum having a rotary shaft; and that the roller housing is rotated about the rotary shaft of the photoconductive drum to move along the circumferential surface of the photoconductive drum, thereby displacing the surface contact position between the first position and the second position along the circumferential surface of the photoconductive drum.

According to this construction, the surface contact position is easily displaced between the first position and the second position along the circumferential surface of the photoconductive drum.

In the above construction, the roller housing preferably includes a contact piece which comes into contact with the rotary shaft of the photoconductive drum. According to this construction, a central axis of rotation of the roller housing coincides with a center of rotation of the photoconductive drum. Therefore, the surface contact position is displaced between the first position and the second position along the circumferential surface of the photoconductive drum.

In the above construction, it is preferable that the image bearing member is a transfer belt driven to turn by a drive roller having a rotary shaft and a driven roller having a rotary shaft; and that the roller housing is rotated about the rotary shaft of either one of the drive roller and the driven roller to move along the circumferential surface of the either one of the drive roller and the driven roller, thereby displacing the surface contact position between the first position and the second position along a surface of the transfer belt.

According to this construction, the surface contact position is displaced between the first position and the second position along the surface of the transfer belt. Thus, the surface contact position is easily displaced between the first position and the second position along the surface of the transfer belt.

In the above construction, the roller housing preferably includes a contact piece which comes into contact with the rotary shaft of either one of the drive roller and the driven roller. According to this construction, a central axis of rotation of the roller housing coincides with a center of rotation of the either one of the drive roller and the driven roller. Therefore, the surface contact position is displaced between the first position and the second position along the surface of the transfer belt.

In the above construction, it is preferable to further comprise a pressing force adjusting member for changing a pressing force for pressing the transfer roller toward the image bearing member depending on whether the surface contact position is at the first position or at the second position.

According to this construction, more suitable conveyance and image transfer are possible according to the thickness of a transfer material.

In the above construction, the pressing force adjusting member preferably includes a contact member held in contact with one end of the pressing member; a supporting member supporting the contact member; and a guide surface formed on the supporting member for changing a pressing force of the pressing member for pressing the transfer roller toward the image bearing member between the first position and the second position by moving the contact member in a direction toward the transfer roller.

According to this construction, it is realized by a simple construction to change the pressing force between the first position and the second position.

In the above construction, the pressing force adjusting member preferably sets the pressing force for pressing the transfer roller toward the image bearing member at the second position stronger than the pressing force for pressing the transfer roller toward the image bearing member at the first position. According to this construction, a transfer material conveying ability and an image transferring ability are improved in the case where the transfer nip portion is formed at the second position.

In the above construction, it is preferable to further comprise a control circuit for obtaining environment information on an execution of an image forming process and controlling the driving of the displacing drive part. According to this construction, the surface contact position is displaced between the first position and the second position according to various conditions such as the thickness of the transfer material. Thus, it is realized to convey the transfer material and transfer an image to the transfer material according to various conditions.

In the above construction, the control circuit preferably controls the driving of the displacing drive part to displace the surface contact position between the first position and the second position using at least one of transfer material thickness information, transfer material size information, information indicating a volume resistance value of the transfer material, information indicating surface smoothness of the transfer material, information indicating in-apparatus temperature, information indicating in-apparatus humidity, sheet feed information indicating a duplex sheet feed to have images transferred to both sides or a simplex sheet feed to have an image transferred to one side and print image information indicating the type of an image as the environment information.

In the above construction, it is preferable to further comprise a control circuit for obtaining environment information on an execution of an image forming process, controlling the driving of the displacing drive part, and controlling ON/OFF timings of a transfer bias for transferring the image to the transfer material and a separation bias for separating the transfer material from the image bearing member to shift by a period corresponding to a moved amount of the transfer roller upon controlling the driving of the displacing drive part to displace the surface contact position between the first position and the second position.

According to this construction, regardless of whether the surface contact position is set to the first position or to the second position, a transfer bias is applied when the transfer material reaches the transfer nip portion and a separation bias is applied after the image is transferred to the transfer material.

Therefore, regardless of whether the surface contact position is set to the first position or to the second position, it is satisfactorily realized to transfer an image to a transfer material in the transfer nip portion and to separate the transfer material having an image transferred thereto in the transfer nip portion from the image bearing member.

This application is based on Japanese Patent Application Serial No. 2008-103191, filed in Japan Patent Office on Apr. 11, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

An image bearing member for transferring an image to a transfer material using a developer;

a transfer roller arranged in contact with a circumferential surface of the image bearing member for forming a transfer nip portion;

a displacing drive part for displacing a surface contact position corresponding to a position of the circumferential surface of the image bearing member where the transfer nip portion is formed by the contact of the transfer roller at least to either one of a first position and a second position different from the first position;

a pressing member for pressing the transfer roller toward the image bearing member, and a pressing force adjusting member for changing a pressing force for pressing the transfer roller toward the image bearing member depending on whether the surface contact position is at the first position or at the second position.

2. An image forming apparatus according to claim 1, further comprising:

a pair of registration rollers for controlling a timing of conveying the transfer material in a direction toward the transfer nip portion; and a first transfer material conveyance path for conveying the transfer material from the pair of registration rollers to the transfer nip portion;

wherein the first transfer material conveyance path becomes straighter when the surface contact position is set to the second position by the displacing drive part than when the surface contact position is set to the first position by the displacing drive part.

3. An image forming apparatus according to claim 2, wherein the second position is located more downstream than the first position in a conveying direction of the transfer material along the circumferential surface of the image bearing member.

4. An image forming apparatus according to claim 1, further comprising:

a second transfer material conveyance path for further conveying the transfer material having passed the transfer nip portion; and a downstream side transfer material guide which projects into the second transfer material conveyance path in such a manner as to come into contact with one surface of the transfer material having passed the transfer nip portion and whose projecting amount into the second transfer material conveyance path changes depending on whether the surface contact position is at the first position or at the second position.

5. An image forming apparatus according to claim 1, further comprising:

a pair of registration rollers for controlling a timing of conveying the transfer material in a direction toward the transfer nip portion;

a first transfer material conveyance path for conveying the transfer material from the pair of registration rollers to the transfer nip portion; and an upstream transfer material guide which projects into the first transfer material conveyance path in such a manner as to come into contact with one surface of the transfer material before passing the transfer nip portion and whose projecting amount into the first transfer material conveyance path changes depending on whether the surface contact position is at the first position or at the second position.

6. An image forming apparatus according to claim 1, further comprising:

a pair of registration rollers for controlling a timing of conveying the transfer material in a direction toward the transfer nip portion;

a first transfer material conveyance path for conveying the transfer material from the pair of registration rollers to the transfer nip portion;

a second transfer material conveyance path for further conveying the transfer material having passed the transfer nip portion;

an upstream transfer material guide which projects into the first transfer material conveyance path in such a manner as to come into contact with one surface of the transfer material before passing the transfer nip portion and whose projecting amount into the first transfer material conveyance path changes depending on whether the surface contact position is at the first position or at the second position; and a downstream side transfer material guide which projects into the second transfer material conveyance path in such a manner as to come into contact with the one surface of the transfer material having passed the transfer nip portion and whose projecting amount into the second transfer material conveyance path changes depending on whether the surface contact position is at the first position or at the second position, the upstream and downstream transfer material guides being displaced in opposite directions.

7. An image forming apparatus according to claim 1, further comprising:

a roller housing for holding the transfer roller and the pressing member and moving the transfer roller along the circumferential surface of the image bearing member by moving along the circumferential surface of the image bearing member;

wherein the displacing drive part displaces the surface contact position between the first position and the second position along the circumferential surface of the image bearing member by moving the roller housing along the circumferential surface of the image bearing member.

8. An image forming apparatus according to claim 7, wherein:

the image bearing member is a photoconductive drum having a rotary shaft; and the roller housing is rotated about the rotary shaft of the photoconductive drum to move along the circumferential surface of the photoconductive drum, thereby displacing the surface contact position between the first position and the second position along the circumferential surface of the photoconductive drum.

9. An image forming apparatus according to claim 8, wherein the roller housing includes a contact piece which comes into contact with the rotary shaft of the photoconductive drum.

10. An image forming apparatus according to claim 7, wherein:

the image bearing member is a transfer belt driven to turn by a drive roller having a rotary shaft and a driven roller having a rotary shaft; and the roller housing is rotated about the rotary shaft of either one of the drive roller and the driven roller to move along the circumferential surface of the either one of the drive roller and the driven roller, thereby displacing the surface contact position between the first position and the second position along a surface of the transfer belt.

11. An image forming apparatus according to claim 10, wherein the roller housing includes a contact piece which comes into contact with the rotary shaft of either one of the drive roller and the driven roller.

12. An image forming apparatus according to claim 1, wherein the pressing force adjusting member includes:

a supporting member supporting the contact member; and a guide surface formed on the supporting member for changing a pressing force of the pressing member for pressing the transfer roller toward the image bearing member between the first position and the second position by moving the contact member in a direction toward the transfer roller.

13. An image forming apparatus according to claim 1, wherein the pressing force adjusting member sets the pressing force for pressing the transfer roller toward the image bearing member at the second position stronger than the pressing force for pressing the transfer roller toward the image bearing member at the first position.

14. An image forming apparatus according to claim 1, further comprising a control circuit for obtaining environment information on an execution of an image forming process and controlling the driving of the displacing drive part.

15. An image forming apparatus according to claim 14, wherein the control circuit controls the driving of the displacing drive part to displace the surface contact position between the first position and the second position using at least one of transfer material thickness information, transfer material size information, information indicating a volume resistance value of the transfer material, information indicating surface smoothness of the transfer material, information indicating in-apparatus temperature, information indicating in-apparatus humidity, sheet feed information indicating a duplex sheet feed to have images transferred to both sides or a simplex sheet feed to have an image transferred to one side and print image information indicating the type of an image as the environment information.

16. An image forming apparatus according to claim 7, further comprising a control circuit for obtaining environment information on an execution of an image forming process and controlling the driving of the displacing drive part, wherein the control circuit controls ON/OFF timings of a transfer bias for transferring the image to the transfer material and a separation bias for separating the transfer material from the image bearing member to shift by a period corresponding to a moved amount of the transfer roller upon controlling the driving of the displacing drive part to displace the surface contact position between the first position and the second position.

* * * * *